United States Patent [19]

Eibner et al.

[11] Patent Number: 4,863,051

[45] Date of Patent: Sep. 5, 1989

[54] LID FOR A LIQUID CONTAINER

[75] Inventors: Robert Eibner, Hilden; Michael Jaschkowitz, Tönisvorst; Bernhard Kloth, Cologne; Wilhelm Kohl, Dormagen; Siegfried Merks, Düsseldorf, all of Fed. Rep. of Germany

[73] Assignee: Schering Aktiengesellschaft, Berlin and Bergkamen, Fed. Rep. of Germany

[21] Appl. No.: 86,689

[22] Filed: Aug. 18, 1987

[30] Foreign Application Priority Data

Aug. 18, 1986 [DE] Fed. Rep. of Germany ..... 3627990

[51] Int. Cl.[4] ..... B65D 51/16

[52] U.S. Cl. ..... 215/261

[58] Field of Search ..... 215/261, 308, 232; 220/372, 371, 367, 373, 359; 229/120

[56] References Cited

U.S. PATENT DOCUMENTS

| | | | |
|---|---|---|---|
| 2,298,938 | 10/1942 | Griffin | 220/373 |
| 3,951,293 | 4/1976 | Schulz | 215/261 |
| 4,044,941 | 8/1977 | Knudsen | 215/232 X |

FOREIGN PATENT DOCUMENTS

| | | | |
|---|---|---|---|
| 14806 | 3/1956 | Fed. Rep. of Germany | 220/373 |

*Primary Examiner*—Donald F. Norton

*Attorney, Agent, or Firm*—Michael J. Striker

[57] ABSTRACT

A lid for a container for gas-releasing liquids includes a sealing cap from a composite foil and having an opening closed by means of a foil of gas-permeable but liquid non-permeable material.

4 Claims, 1 Drawing Sheet

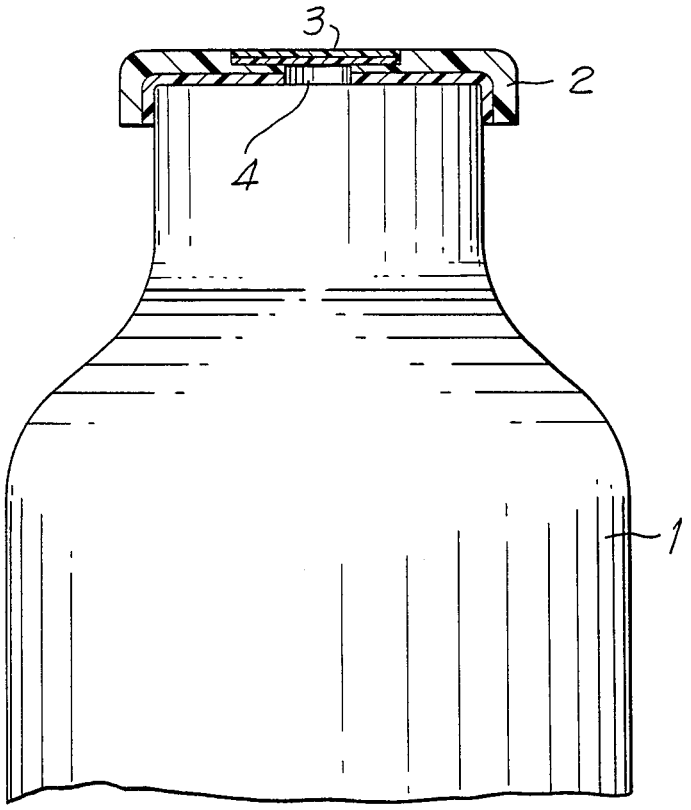
3
2
4
1

LID FOR A LIQUID CONTAINER

BACKGROUND OF THE INVENTION

The present invention relates to a lid or stopper for a liquid container, which includes a sealing lid serving as an original lid and a lid for a pressure compensation.

Packing of liquids, solutions and concentrates normally requires that containers, for example, cans, bottles, buckets, pitchers or pots be firstly provided with an original lid which is a sealing cap and then be closed with a lid.

The original lid or sealing cap is formed of a welded aluminum foil which hermetically seals a vessel; such a sealing cap, however, can raise a problem in cases of gas-splitting, and particularly gas-releasing liquids contained in a vessel. In such cases a degasing valve must be inserted in the lid for a pressure compensation, and an additional safety cap should be provided which has involved undesired time and material consumption.

SUMMARY OF THE INVENTION

It is an object of the present invention to provide an improved lid for a liquid container.

It is another object of the invention to provide a lid suitable for containers containing gas-releasing products and manufactured in a very simple manner.

These and other objects of the invention are attained by a lid for a liquid container, comprising a sealing cap which serves as an original lid and a pressure-compensating lid, said sealing cap being formed of a composite foil having an opening, said pressure compensating lid being a gas-permeable but liquid-non-permeable foil which closes said opening.

The composite foil may be made of aluminum polyethylene.

The pressure-compensating lid may be made of microfilter laminate.

The opening in the sealing cap may be dimensioned so as to satisfy a degassing requirement.

The microfilter laminate may be made on the base of polytetrafluorethylene.

The objects of the invention are also attained by a method of using a composite foil of aluminum polyethylene having an opening closed with a gas-permeable but liquid-tight foil for a lid of a container for containing gas-releasing liquid.

Due to the invention a required original lid can provide also a gas-permeable action and be made in a single process with the use of only one material piece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The sole FIGURE shows a partial elevational view of the container with a lid shown in section.

DETAILED DESCRIPTION OF THE PREFERRED EMBODIMENT

The lid for a container according to the invention includes two lid parts. Customary materials can be utilized for the container 1.

The lid or plug includes two parts 2 and 3 one of which is an original lid closing the container as a sealing cap and has an opening 4 dimensioned to provide gas escaping from the container, and the other of which closes the opening. Both parts are formed of a foil material. The sealing cap 2 is formed of composite foil made, for example, of aluminum and polyethylene while the other part of the lid is a gas permeable but liquid-non-permeable permeable foil 3 made of microfilter laminate, particularly on the base of polytetrafluorethylene.

The plug or lid of this invention is suitable for all liquid containers, such as cans, bottles, barrels, buckets, pots, etc. for containing gas-releasing products, for example, surface treating solutions or liquid fertilizers. Various liquids in the form of solutions, concentrates, creams, pastes, emulsions, suspensions or oils can be stored in the containers provided with the lid according to the invention.

It will be understood that each of the elements described above, or two or more together, may also find a useful application in other types of container lids differing from the types described above.

While the invention has been illustrated and described as embodied in a container lid it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lid for a container which stores gas-releasing liquids and has an opening end portion, the lid comprising a sealing cap which serves as an original lid and is formed so as to close an opening end portion of a container to prevent a liquid contained in the container from escaping the container, said sealing cap being formed of a composite foil having a central opening which is dimensioned to insure escaping of gas released from a liquid from the container; and a pressure compensating lid which closes said opening of said sealing cap and is composed of a gas-permeable but liquid-non-permeable foil, said pressure compensating lid being formed as microfilter laminate, said sealing cap having substantially flat whole inner and upper surfaces extending substantially parallel to one another, said central opening of said sealing cap being stepped and having an outer wider opening portion located adjacent to said outer surface of said sealing cap and a narrower lower portion located adjacent to said lower surface of said sealing cap, said pressure compensating lid being arranged in said wider opening portion of said opening of said sealing cap and flush with said flat upper surface of said sealing cap.

2. The lid as defined in claim 1, wherein said composite foil is made of aluminum and polyehylene.

3. The lid as defined in claim 1, wherein said laminate is made on the base of polytetrafluorethylene.

4. A lid for a container which stores gas-releasing liquids and has an opening end portion, the lid comprising a sealing cap which serves as an original lid and is formed so as to close an opening end portion of a container to prevent a liquid contained in the container from escaping the container, said sealing cap being formed of a composite foil and having a central opening which is dimensioned to insure escaping of gas released from a liquid from the container; and a pressure compensating lid which closes said opening of said sealing cap and is composed of a gas-permeable but liquid-non-permeable foil, said pressure compensating lid being formed as microfilter laminate, said sealing cap having substantially flat whole inner and upper surfaces extending substantially parallel to one another, said central opening of said sealing cap being stepped and having an outer wider opening portion located adjacent to said outer surface of said sealing cap and a narrower lower portion located adjacent to said lower surface of said sealing cap, said pressure compensating lid being arranged in said wider opening portion of said opening of said sealing cap and flush with said upper surface of said sealing cap, said composite foil of said sealing lid being made of aluminum and polyethylene, while said pressure compensated lid is made of a microfilter laminate.

* * * * *